US005600336A

United States Patent [19]

Kubo et al.

[11] Patent Number: 5,600,336

[45] Date of Patent: Feb. 4, 1997

[54] ANTENNA DEVICE AND SATELLITE COMMUNICATION RECEPTION SYSTEM

[75] Inventors: Kazuhara Kubo; Takayoshi Tsurumaki; Masahiro Tamura, all of Kawasaki, Japan

[73] Assignee: Fujitsu Limited, Kawasaki, Japan

[21] Appl. No.: 289,587

[22] Filed: Aug. 15, 1994

[30] Foreign Application Priority Data

Jan. 31, 1994 [JP] Japan ..... 6-009292

[51] Int. Cl.[6] ..... H01Q 13/00

[52] U.S. Cl. ..... 343/756; 333/248; 333/254; 343/786

[58] Field of Search ..... 343/756, 776, 343/840, 786, 858, 779; 333/21 A, 248–250, 254–256, 260; H01Q 13/00, 13/02, 1/50

[56] References Cited

U.S. PATENT DOCUMENTS 3,037,204 5/1962 Allen et al. ..... 343/776

4,011,532 3/1977 Williams et al. ..... 333/255

5,461,394 10/1995 Weber ..... 343/776

*Primary Examiner*—Michael C. Wimer

*Attorney, Agent, or Firm*—Staas & Halsey

[57] ABSTRACT

An antenna device for receiving a radio wave transmitted from a communication satellite, converting the received radio wave into an electric signal, amplifying the signal, and outputting the amplified signal to a receiver is capable of quickly resuming a radio wave reception in the event of a failure. The antenna device includes a converter assembly having a straight waveguide and a twisted waveguide for supplying polarized radiowaves in the same direction to two LNBs, which are oriented in the same direction and fixed to a fixing adapter that is slidably mounted on a holder unit. Even when one of the LNBs suffers a failure, the other normal LNB can be used as a spare LNB and simply moved to replace the malfunctioning LNB. Therefore, any malfunctioning LNB can be replaced easily for quick resumption of a radio wave reception. A satellite communication reception system employs such an antenna device.

12 Claims, 11 Drawing Sheets

ANTENNA DEVICE AND SATELLITE COMMUNICATION RECEPTION SYSTEM

BACKGROUND OF THE INVENTION (1) Field of the Invention

The present invention relates to an antenna device for receiving a radio wave transmitted from a communication satellite, converting the received radio wave into an electric signal, amplifying the signal, and outputting the amplified signal to a receiver, and a satellite communication reception system including an antenna device and a receiver.

(2) Description of the Related Art

In recent years, satellite communications have been finding widespread use as a new data transmission medium in international and domestic communication fields. A satellite communication system comprises a satellite orbiting around the earth and transmission and reception earth stations for accessing the satellite.

The reception earth station has an antenna device for receiving weak radiowaves transmitted from the satellite. The antenna device includes a converter assembly composed of an orthogonal mode transducer (OMT) and a low-noise block converter (LNB).

FIG. 9 of the accompanying drawings shows the converter assembly of a conventional antenna device. In FIG. 9, the converter assembly, generally denoted at 100*m*, serves to convert a radio wave received by an antenna (not shown) into an electric signal. The converter assembly 100*m* comprises an OMT 1 and an LNB 2*m*. The OMT 1 comprises a radio wave receiver 101 on a distal end thereof, a waveguide 102 contiguous to the radio wave receiver 101, and vertical and horizontal branching filters 103, 104 extending from the waveguide 102.

The LNB 2*m* is connected to the vertical and horizontal branching filters 103, 104 through a flange 105*m* having waveguide ports 106*m*, 107*m* (see FIG. 10 of the accompanying drawings) which are angularly displayed 90° from each other. The vertical and horizontal branching filters 103, 104 also have respective waveguide ports (not shown in FIGS. 9 and 10) which are also angularly displayed 90° from each other as with the waveguide ports 106*m*, 107*m*.

The LNB 2*m* comprises a vertical polarization LNB 50*m* and a horizontal polarization LNB 60*m* which are of an identical structure. The vertical polarization LNB 50*m* and the horizontal polarization LNB 60*m* are attached to the flange 105*m* such that they are angularly displayed 90° from each other in registry with the waveguide ports 106*m*, 107*m*, respectively.

The vertical polarization LNB 50*m* is connected to the vertical branching filter 103 through the flange 105*m*, and the horizontal polarization LNB 60*m* is connected to the horizontal branching filter 104 through the flange 105*m*. The converter assembly 100*m* is supported by a support arm 111 extending from an end of the waveguide 102 which is joined to the radio wave receiver 101. The support arm 111 is fixed to an end 110*m* of an antenna.

A radio wave received by the antenna is supplied from the radio wave receiver 101 of the OMT 1, passes through the waveguide 102, and then is branched by the vertical and horizontal branching filters 103, 104 into vertically and horizontally polarized radiowaves, which are supplied to the respective LNBs 50*m*, 60*m*. The LNBs 50*m*, 60*m* amplify and convert the vertically and horizontally polarized radiowaves. For example, the LNBs 50*m*, 60*m* amplify and convert a radio wave in a 12 GHz band, which is transmitted from a broadcast satellite into a radio wave having a frequency in a 1 GHz band.

A satellite communication reception system employing the converter assembly 100*m* will be described below with reference to FIG. 11 of the accompanying drawings.

FIG. 11 shows an overall arrangement of a conventional satellite communication reception system. The illustrated satellite communication reception system is a CS broadcast reception system for receiving CS broadcast radiowaves from a satellite with television monitors. The satellite communication reception system has an antenna 110 for efficiently catching a weak 12 GHz radio wave transmitted from a satellite and supplying the received radio wave to the converter assembly 100*m*. The radio wave travels through the OMT 1 of the converter assembly 100*m* to the LNB 2*m* in which the vertically polarized radio wave V is amplified and converted into a signal having a frequency of 1 GHz by the vertical polarization LNB 50*m* and the horizontal polarized radio wave H is amplified and converted into a signal having a frequency of 1 GHz by the horizontal polarization LNB 60*m*. The frequency-converted signals are received by respective CS receivers (CS tuners) 71, 81, which output video and audio signals to television monitors 72, 82.

In the event of a failure of either one of the vertical polarization LNB 50*m* and horizontal polarization LNB 60*m*, a makeshift effort is made by removing the malfunctioning LNB 50*m* or 60*m*, turning the LNB 50*m* or 60*m* which is normal by 90°, and installing the turned LNB 50*m* or 60*m*.

For example, if the reception of a vertically polarized radio wave is indicated by the transmitting station, then when the vertical polarization LNB 50*m* fails to operate, four screws 108*m* (see FIG. 10) interconnecting the vertical polarization LNB 50*m* and the flange 105*m* are loosened, and the vertical polarization LNB 50*m* is detached from the flange 105*m*. At the same time, four screws 109*m* interconnecting the horizontal polarization LNB 60*m* which is not malfunctioning and the flange 105*m* are also loosened and removed from the flange 105*m*. Then, the horizontal polarization LNB 60*m* is angularly displaced 90°, and fastened by the four screws 108*m* to the flange 105*m* in the position from which the vertical polarization LNB 50*m* has been detached, i.e., over the waveguide port 106*m*. The waveguide port 107*m* which has been exposed is closed by a lid plate (not shown) using the four screws 109*m* to prevent from being made a hole in the horizontal polarization LNB60*m* of the frange 105*m*.

Therefore, when either one of the vertical polarization LNB 50*m* and the horizontal polarization LNB 60*m* suffers a failure, it has been tedious and timing-consuming to remove the faulty condition. If such a failure occurs in the middle of a radio wave reception, then the radio wave reception will be interrupted for a long period of time, resulting a possibility for the user to miss some important information which may be carried by the transmitted radio wave.

In the satellite communication reception system shown in FIG. 11, the LNBs 50*m*, 60*m* are supplied with electric energy from either the CS receivers 71, 81 or power supplies 73, 83, respectively. In such a power supply system, the CS receiver 71 or the power supply 73 for supplying electric energy to the LNB 50*m* is independent of the CS receiver 81 or the power supply 83 for supplying electric energy to the LNB 60*m*. Consequently, in the event that the CS receiver 71 or the power supply 73, or the CS receiver 81 or the power supply 83 fails to operate, the LNB 50*m* or 60*m* also fails to operate, resulting in the interruption of a radio wave reception as with the failure of the LNB 50*m* or 60*m* itself.

SUMMARY OF THE INVENTION

It is thereof an object of the present invention to provide an antenna device which is capable of resuming a radio wave reception quickly even in the event of a fault of an LNB.

Another object of the present invention is to provide satellite communication reception system which is capable of resuming a radio wave reception immediately after a power supply system for supplying electric energy to an LNB fails to operate.

To achieve the above object, there is provided in accordance with the present invention an antenna device for receiving a radio wave transmitted from a communication satellite, converting the received radio wave into an electric signal, amplifying the signal, and outputting the amplified signal to a receiver, comprising a pair of low-noise block converters for converting radiowaves supplied from respective radio wave receiving ports thereof into electric signals and amplifying the electric signals, a fixing adapter, the low-noise block converters being arranged in an array and fixed at the radio wave receiving ports thereof to the fixing adapter, the fixing adapter having a pair of respective radio wave passage openings in registry with the radio wave receiving ports, respectively, of the low-noise block converters, a holder unit, the fixing adapter being held on the holder unit for sliding movement in a direction along the array, the holder unit having a pair of respective radio wave passage openings in registry with the radio wave passage openings, respectively, of the fixing adapter, and a waveguide unit mounted on a surface of the holder unit remotely from the fixing adapter and adapted to be connected to an orthogonal mode transducer for receiving a radio wave from the satellite, the waveguide unit comprising a straight waveguide for guiding a radio wave from the orthogonal mode transducer straight to one of the low-noise block converters and a twisted waveguide for turning a radio wave from the orthogonal mood transducer through 90° and guiding the radio wave to one of the low-noise block converters.

According to the present invention, there is also provided an antenna device for receiving a radio wave transmitted from a communication satellite, converting the received radio wave into an electric signal, amplifying the signal, and outputting the amplified signal to a receiver, comprising a pair of vertical polarization low-noise block converters for converting vertically polarized radiowaves supplied from respective radio wave receiving ports thereof into electric signals and amplifying the electric signals, a pair of horizontal polarization low-noise block converters for converting horizontally polarized radiowaves supplied from respective radio wave receiving ports thereof into electric signals and amplifying the electric signals, a vertical polarization fixing adapter, the vertical polarization low-noise block converters being arranged in an array and fixed at the radio wave receiving ports thereof to the vertical polarization fixing adapter, the vertical polarization fixing adapter having a pair of respective radio wave passage openings in registry with the radio wave receiving ports, respectively, of the vertical polarization low-noise block converters, a horizontal polarization fixing adapter, the horizontal polarization low-noise block converters being arranged in an array and fixed at the radio wave receiving ports thereof to the horizontal polarization fixing adapter, the horizontal polarization fixing adapter having a pair of respective radio wave passage openings in registry with the radio wave receiving ports, respectively, of the horizontal polarization low-noise block converters, a holder unit having a vertical polarization holder and a horizontal polarization holder, the vertical polarization fixing adapter being held on the vertical polarization holder for sliding movement in a direction along the array, the vertical polarization holder having a radio wave passage opening in registry with one of the radio wave passage openings, respectively, of the vertical polarization fixing adapter, the horizontal polarization fixing adapter being held on the horizontal polarization holder for sliding movement in a direction along the array, the horizontal polarization holder having a radio wave passage opening in registry with one of the radio wave passage openings, respectively, of the horizontal polarization fixing adapter, and an orthogonal mode transducer mode mounted on a surface of the holder unit remotely from the vertical and horizontal fixing adapters, for guiding vertically and horizontally polarized radiowaves branched from the radio wave from the communication satellite into the radio wave passage openings of the holder unit.

According to the present invention, there is further provided an antenna device for receiving a radio wave transmitted from a communication satellite, converting the received radio wave into an electric signal, amplifying the signal, and outputting the amplified signal to a receiver, comprising a pair of vertical polarization low-noise block converters for converting vertically polarized radiowaves supplied from respective radio wave receiving ports thereof into electric signals and amplifying the electric signals, a pair of horizontal polarization low-noise block converters for converting horizontally polarized radiowaves supplied from respective radio wave receiving ports thereof into electric signals and amplifying the electric signals, a fixing adapter, the vertical and horizontal polarization low-noise block converters being arranged at diagonally opposite positions concentrically around the center of the fixing adapter and fixed at the radio wave receiving ports thereof to the fixing adapter, the fixing adapter having a plurality of respective radio wave passage openings in registry with the radio wave receiving ports, respectively, of the vertical and horizontal polarization low-noise block converters, the fixing adapter having a hole defined therein at the center thereof for rotation about the hole, holder unit, the fixing adapter being held on the holder unit, the holder unit having a pair of respective radio wave passage openings in registry with respective ones of the radio wave passage openings, respectively, of the fixing adapter, the holder unit having a hole defined therein for rotation about the hole, the hole of the holder unit being held in registry with the hole of the fixing adapter, and an orthogonal mode transducer mounted on a surface of the holder unit remotely from the fixing adapter, for guiding vertically and horizontally polarized radiowaves branched from the radio wave from the communication satellite into the radio wave passage openings of the holder unit.

According to the present invention, there is also provided a satellite communication reception system for receiving a radio wave transmitted from a communication satellite, converting the received radio wave into an electric signal, amplifying the signal, and outputting the amplified signal to a terminal, comprising a vertical polarization low-noise block converter for converting a vertically polarized radio wave branched from the radio wave from the communication satellite into an electric signal and amplifying the electric signal, a vertical polarization power supply for supplying a voltage to the vertical polarization low-noise block converter, a horizontal polarization low-noise block converter for converting a horizontally polarized radio wave branched from the radio wave from the communication satellite into an electric signal and amplifying the electric signal, a horizontal polarization power supply for supplying a voltage to the horizontal polarization low-noise block converter, and a power supply switching device connected between the vertical polarization low-noise block converter and the vertical polarization power supply and between horizontal polarization low-noise block converter and the horizontal polarization power supply, the power supply switching device including a diode connected between the horizontal polarization power supply and the vertical polarization low-noise block converter for supplying therethrough the voltage from the horizontal polarization power supply to the vertical polarization low-noise block converter when the supply of the voltage from the vertical polarization low-noise block converter to the vertical polarization power supply is interrupted, and a diode connected between the vertical polarization power supply and the horizontal polarization low-noise block converter for supplying therethrough the voltage from the vertical polarization power supply to the horizontal polarization low-noise block converter when the supply of the voltage from the horizontal polarization low-noise block converter to the horizontal polarization power supply is interrupted.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 2:
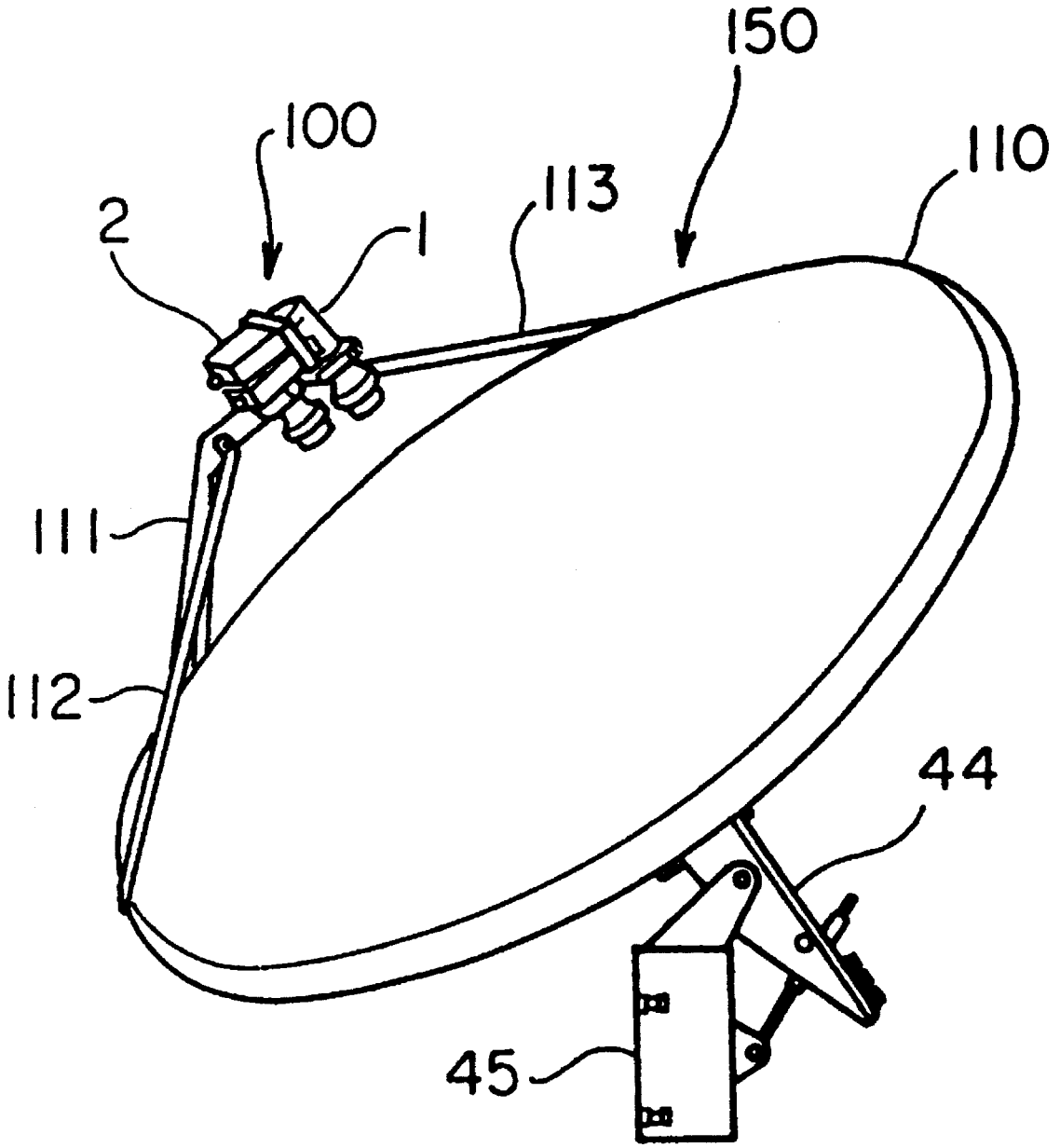
FIG. 2 is a perspective view of the antenna device according to the present invention in its entirety.

FIG. 2 shows in perspective an antenna device according to the present invention. In FIG. 2, the antenna device, generally denoted at 150, comprises an antenna 110 and a converter assembly 100. The antenna 110 catches weak radio wave transmitted from a satellite and supplying the received radio wave to the converter assembly 100. The antenna 110 is fixed to a mast attachment 45 through a latitude adjuster 44.

The converter assembly 100 is positioned closely to the center of the antenna 110, but spaced slightly upwardly from the antenna 110. The converter assembly 100 is supported on the antenna 110 by a support arm 111 attached to the antenna 110 and braced by a pair of arms 112, 113.

Figure 9:
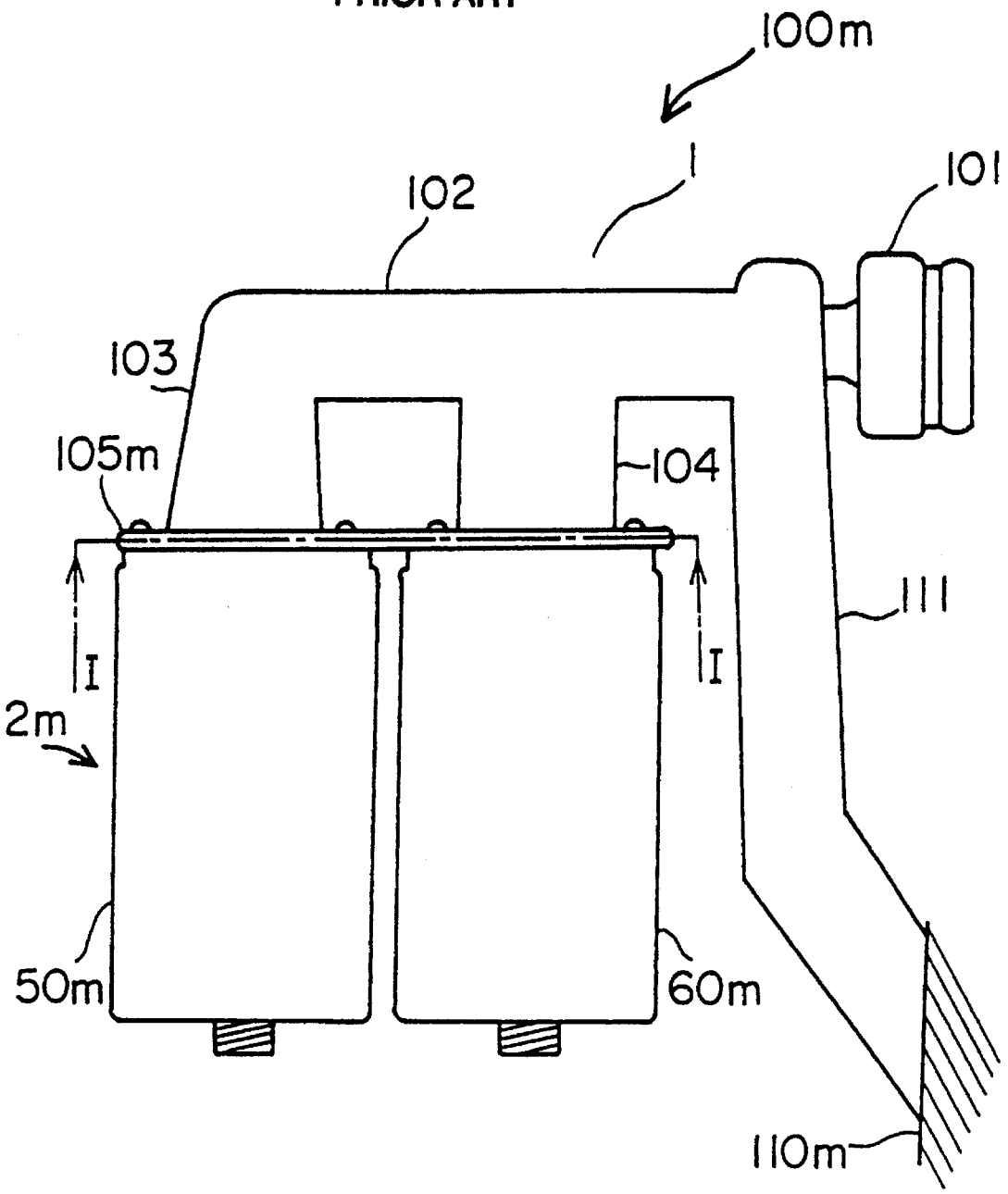
FIG. 9 PRIOR ART
FIG. 9 is a side elevational view of a converter assembly of a conventional antenna device.
Figure 10:
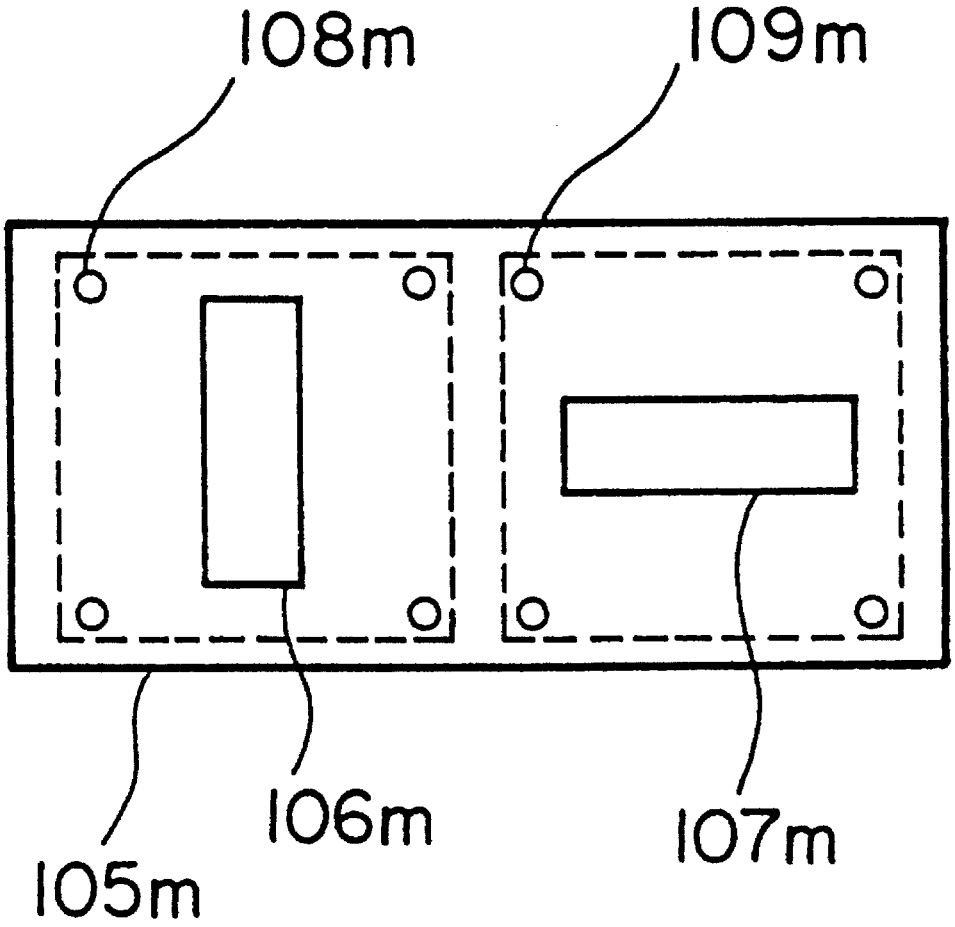
FIG. 10 PRIOR ART
FIG. 10 is a bottom view of a flange of the converter assembly shown in FIG. 9.
Figure 11:
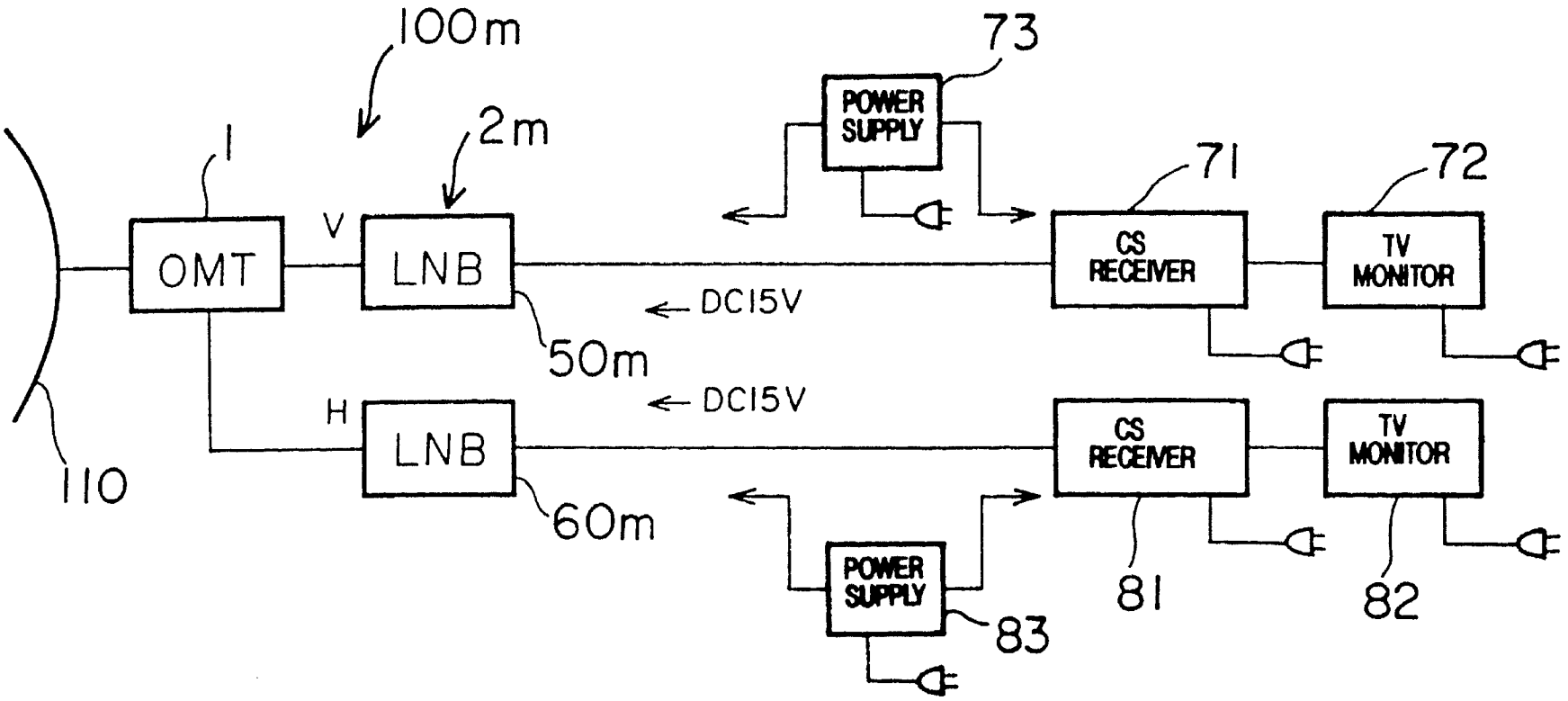
FIG. 11 PRIOR ART
FIG. 11 is a block diagram of a conventional satellite communication reception system.

The converter assembly 100, which serves to convert a radio wave received by the antenna 110 into an electric signal, comprises an OMT 1 and an LNB 2. The OMT 1 is identical in structure to the OMT 1 shown in FIG. 9, and will not be described in detail below. The LNB 2 of the converter assembly 100 will be described below with reference to FIGS. 1, 3, and 4.

Figure 1:
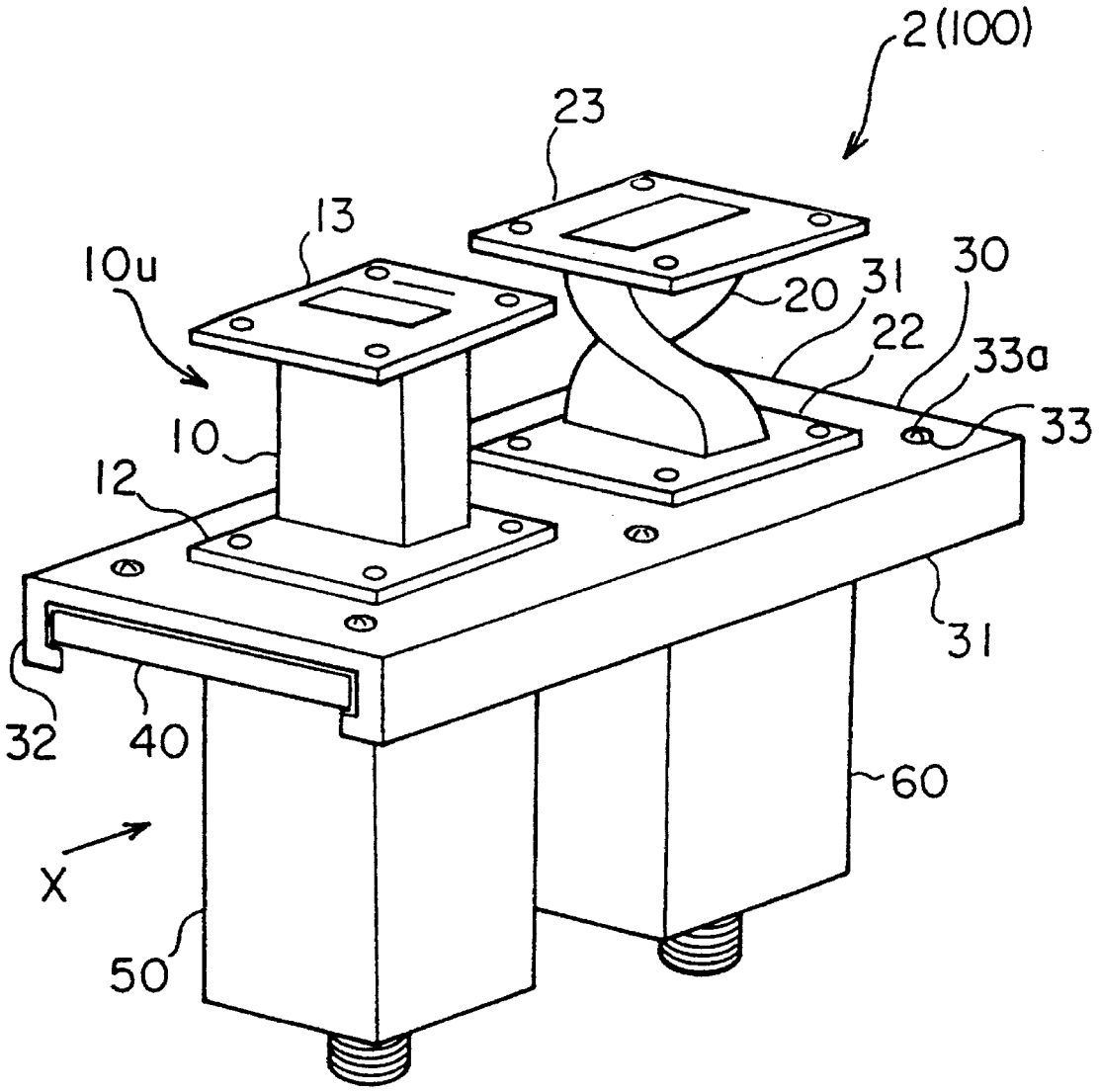
FIG. 1 is a perspective view of an LNB of a converter assembly of antenna device according to a first embodiment of the present invention.

FIG. 1 shows the LNB 2 of the converter assembly 100 in detail. As shown in FIG. 1, the LNB 2 comprises a waveguide unit 10*u*, a holder unit 30, a fixing adapter 40, and a pair of LNBs 50, 60. The OMT 1 is connected to upper surfaces of respective two flanges 13, 23 of the waveguide unit 10*u*.

The LNBs 50, 60 serve to convert radiowaves transmitted from respective radio wave receiving ports (not shown) into respective electric signals and amplify the electric signals. The LNBs 50, 60 are identical in structure to each other. The LNBs 50, 60 are arranged in an array extending in the longitudinal direction of the fixing adapter 40. The structure of the fixing adapter 40 will be described below with reference to FIGS. 3(A) and 3(B).

Figure 3A:
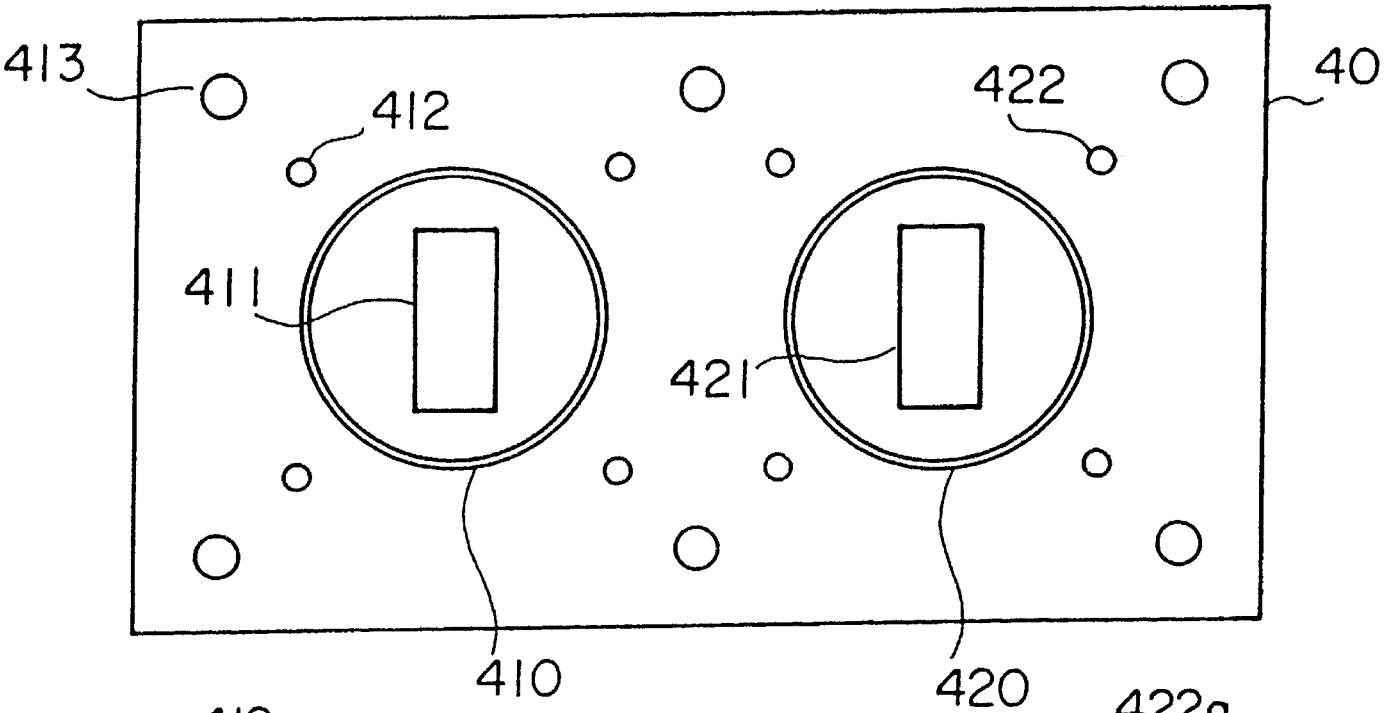
FIG. 3(A) is a bottom view of a fixing adapter of the LNB shown in FIG. 1.
Figure 3B:
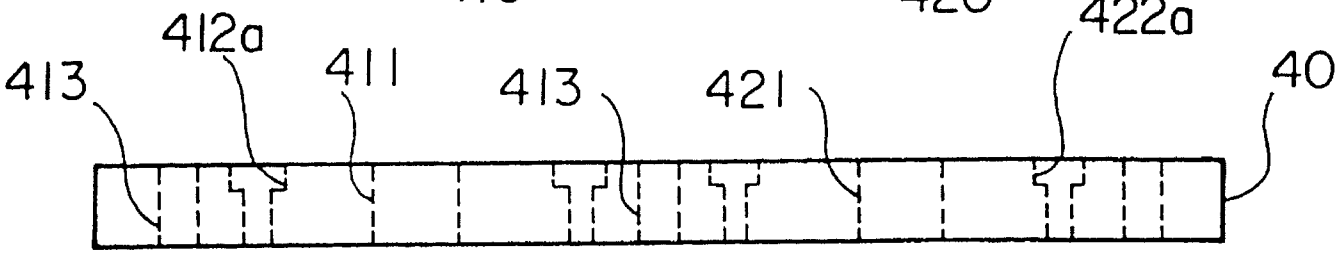
FIG. 3(B) is a side elevational view of the fixing adapter.

FIGS. 3(A) and 3(B) show bottom and side surfaces, respectively, of the fixing adapter 40. The fixing adapter 40 is in the form of a rectangular plate having a pair of O-ring grooves 410, 420 defined in a lower surface thereof. The O-ring grooves 410, 420 receive O-rings, respectively, which are disposed between the fixing adapter 40 and the LNBs 50, 60 when the LNBs 50, 60 are fixed to the fixing adapter 40. The fixing adapter 40 has a pair of waveguide ports or radio wave passage openings 411, 421 defined therein at the centers, respectively, of the O-ring grooves 410, 420. The waveguide ports 411, 421 are oriented in the same direction, i.e., extend parallel to each other, because the waveguide unit 10*u* comprises a straight waveguide 10 and a twisted waveguide 20, as described in detail later on.

The fixing adapter 40 also has four equidistantly spaced screw holes 412 defined therein around the O-ring grooves 410 for allowing the LNB 50 to be fastened to the fixing adapter 40 with screws, and four equidistantly spaced screw holes 422 defined therein around the O-ring grooves 420 for allowing the LNB 60 to be fastened to the fixing adapter 40 with screws. The eight screw holes 412, 422 have respective spot-faced holes 412*a*, 422*a* defined in the upper surface of the fixing adapter 40 which is held in contact with the holder unit 30, so that any screws used to fasten the LNBs 50, 60 to the fixing adapter 40 are kept out of contact with the holder unit 30. The fixing adapter 40 further has six screw holes 413 defined therein along peripheral edges thereof for fastening the fixing adapter 40 to the holder unit 30 with screws.

The O-ring grooves 410, 420, the screw holes 412, 422, and the waveguide ports 411, 421 are positioned symmetrically with respect to a transverse central axis of the fixing adapter 40. The six screw holes 413 are also positioned symmetrically with respect to the transverse central axis of the fixing adapter 40.

The holder unit 30 serves to hold the fixing adapter 40 for sliding movement in the longitudinal direction thereof. The holder unit 30 comprises relatively thick plate and has a pair of laterally spaced inturned flanges or rails 31, 32 along respective longitudinal edges thereof. The fixing adapter 40 has longitudinal edges which are slidably fitted in the inturned flanges or rails 31, 32. As with the fixing adapter 40, the holder unit 30 has two waveguide ports or radio wave passage openings (not shown) defined therein in registry with the respective LNBs 50, 60. The holder unit 30 has six screw holes 33 defined therein in registry with the respective screw holes 413 in the fixing adapter 40 for fastening the fixing adapter 40 to the holder unit 30 with screws. The screw holes 33, 413 are positioned such that when the fixing adapter 40 is slid longitudinally with respect to the holder unit 30, four of the screw holes 413 can be brought into registry with four of the screw holes 33, so that the screw holes 413 can be shared by the screw holes 33.

The waveguide unit 10*u* comprises a straight waveguide 10 and a twisted waveguide 20 which are connected through respective flanges 12, 22 to the holder unit 30. The straight waveguide 10 serves to receive a polarized radio wave from the OMT 1 through the flange 13, and guide the received polarized radio wave straight to the LNB 50. The twisted waveguide 20 serves to receive a polarized radio wave from the OMT 1 through the flange 23, and turn the received polarized radio wave through 90° and guide it to the LNB 60. If a vertically polarized radio wave is introduced into the straight waveguide 10 and a horizontal polarized radio wave is introduced into the twisted waveguide 20, then the vertically polarized radio wave is guided as it is to the LNB 50, and the horizontally polarized radio wave is turned 90° and guided, as a radio wave polarized in the same direction as the vertically polarized radio wave, to the LNB 60. As a result, the radiowaves that have passed through the waveguide unit 10*u* and are supplied to the respective LNBs 50, 60 are polarized in the same direction, i.e., vertically polarized. The LNBs 50, 60 are thus oriented in the same direction to receive the vertically polarized radiowaves. The interconnection between the waveguide unit 10*u*, the holder unit 30, the fixing adapter 40, and the LNBs 50, 60 will be described below with reference to FIG. 4.

Figure 4:
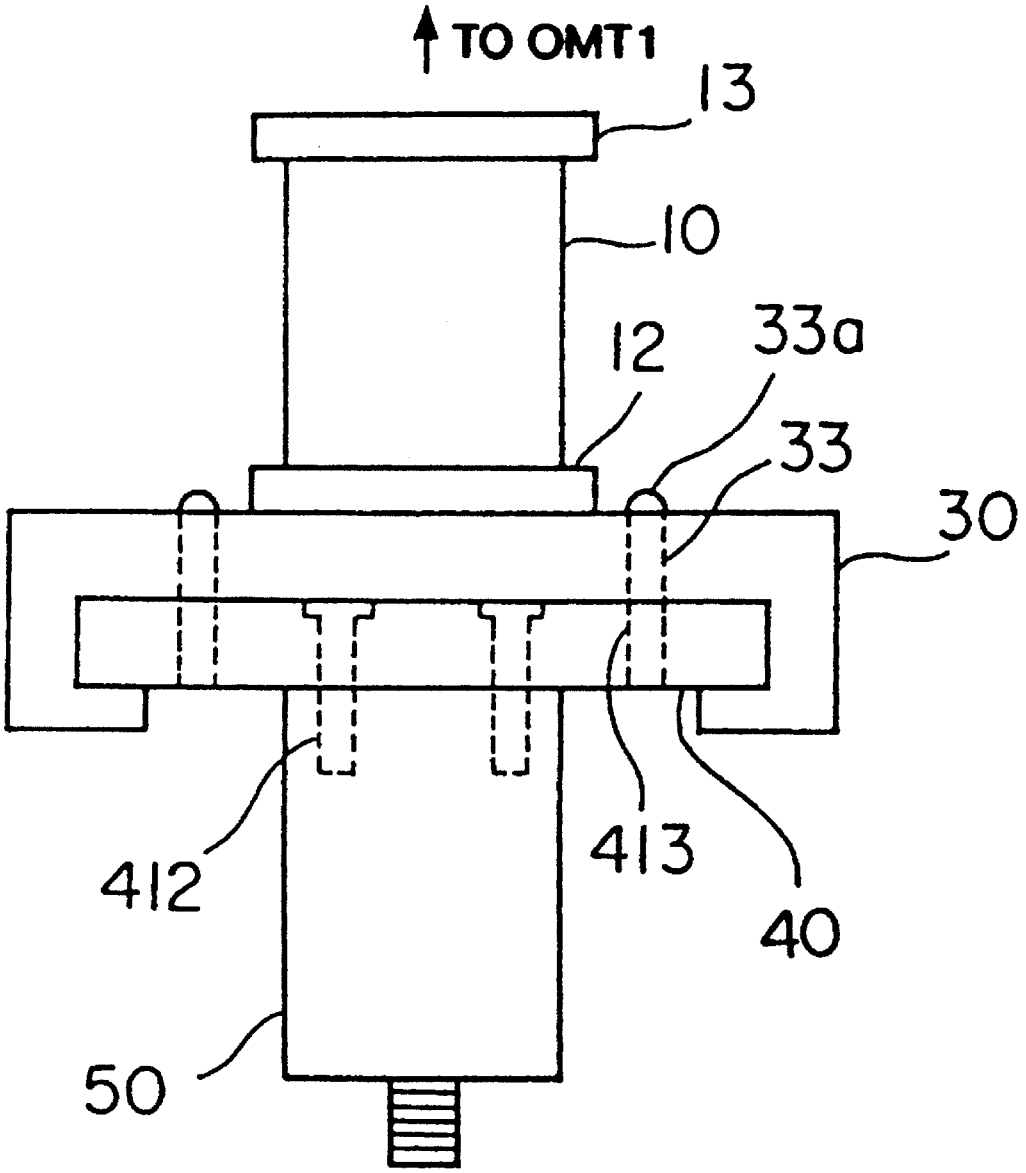
FIG. 4 is an end elevational view of the LNB as viewed in the direction indicated by the arrow X in FIG.

FIG. 4 is a view as viewed in the direction indicated by the arrow X in FIG. 1. As shown in FIG. 4, the LNB 50 and the fixing adapter 40 are fastened to each other by screws fitted in the screw holes 412 and screw holes in the LNB 50, and the fixing adapter 40 and the holder unit 30 are fastened to each other by screws 33*a* fitted in the screw holes 413, 33. The flange 12 is interposed between the straight waveguide 10 and the holder unit 30, and the flange 13 is interposed between the straight waveguide 10 and the OMT 1. Water-resistance seals such as O-rings, for example, are disposed around the waveguide ports 411, 421 through which radiowaves pass. While the interconnecting structure relative to the LNB 50 has been described above, the same interconnecting structure is employed with respect to the LNB 60.

It is assumed that one of the LNBs 50, 60, e.g., the LNB 50, fails to operate. As described above, the LNBs 50, 60 are of an identical structure and are installed in the same direction. The screws 33*a* are loosened and removed, and the fixing adapter 40 is slid longitudinally in the holder unit 30 until the normal LNB 60 is positioned in alignment with the straight waveguide 10. After the LNB 60 is aligned with the straight waveguide 10, the fixing adapter 40 is fastened again to the holder unit 30 by the screws 33*a*. Since the fixing adapter 40 is slid to bring the LNB 60, rather than the malfunctioning LNB 50, into alignment with the straight waveguide 10, any interrupted radio wave reception can be resumed quickly.

At this time, the malfunctioning LNB 50 projects from the holder unit 30. To protect the interior mechanism of the malfunctioning LNB 50, a water resistant seal is applied to the radio wave receiving port of the LNB 50.

In the event that the LNB 60 suffers a failure, the normal LNB 50 is brought into alignment with the twisted waveguide 20 for quickly resuming any interrupted radio wave reception.

In this embodiment, the use of the straight waveguide 10 and the twisted waveguide 20 allows the two LNBs 50, 60 to be oriented in the same direction. The two LNBs 50, 60 are fixed to the fixing adapter 40, which is in turn slidably mounted on the holder unit 30. Even when either the LNB 50 or the LNB 60 malfunctions, the other normal LNB 50 or 60 can be used as a spare LNB and simply moved to replace the malfunctioning LNB. Accordingly, the process of replacing the malfunctioning LNB 50 or 60 is greatly simplified, and the LNB failure can easily be handled by an ordinary person, rather than a repairman, for quick resumption of any interrupted radio wave reception.

Figure 5:
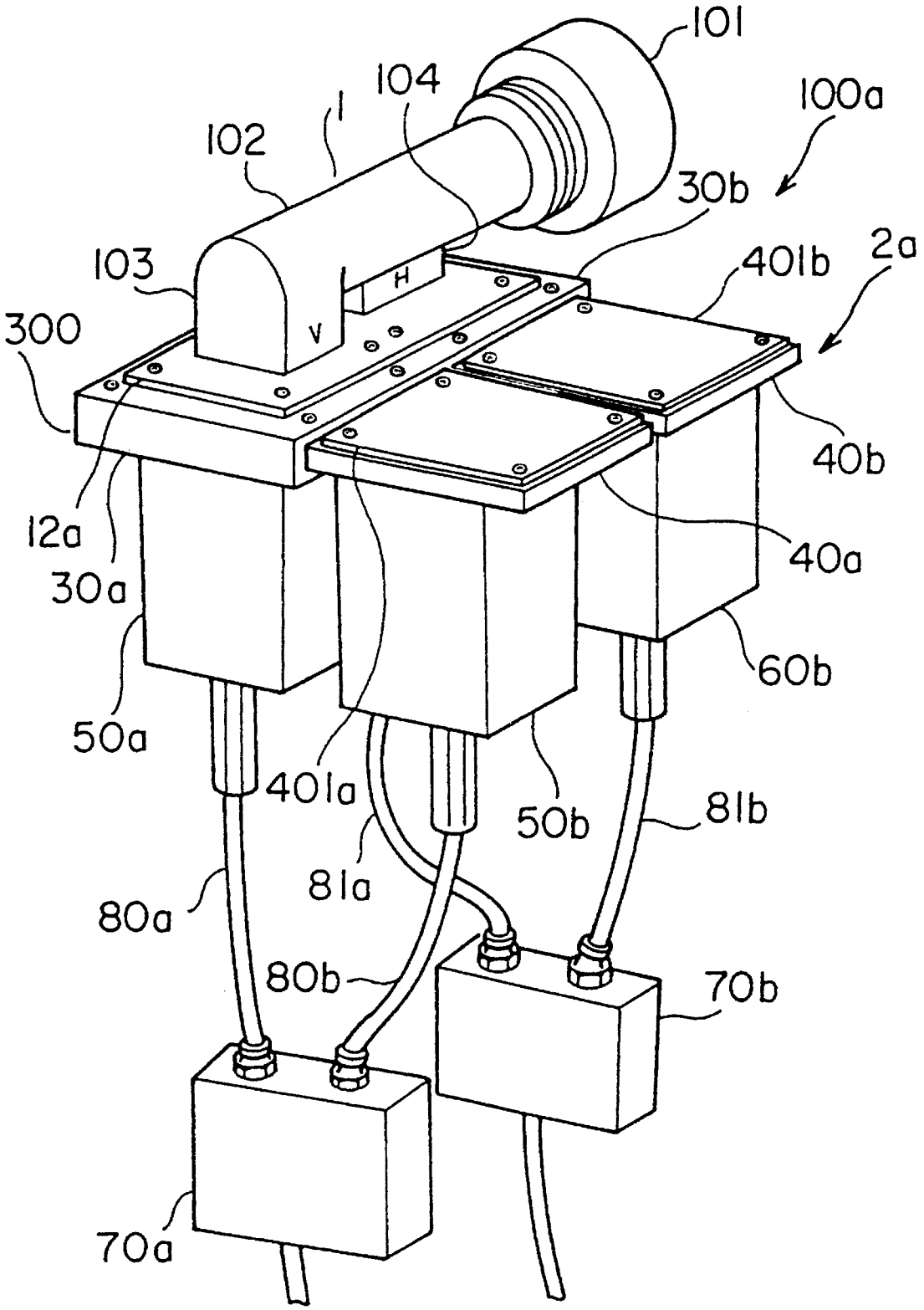
FIG. 5 is a perspective view of a converter assembly of an antenna device according to a second embodiment of the present invention.

FIG. 5 illustrates a converter assembly of an antenna device according to a second embodiment of the present invention. As shown in FIG. 5, the converter assembly, generally denoted at 100*a*, has an OMT 1 which is identical in structure to the OMT 1 shown in FIG. 9, and will not be described in detail below. The converter assembly 100*a* also has an LNB 2*a* which will be described below.

The LNB 2*a* comprises an array of vertical polarization LNBs 50*a*, 50*b* arranged in the longitudinal direction of a fixing adapter 40*a*, and an array of horizontal polarization LNBs 60*a*, 60*b* arranged in the longitudinal direction of a fixing adapter 40*b*. The LNB 60*a* is not shown in FIG. 5 as it is concealed from view. The LNB 2*a* also includes a holder unit 300 comprising a vertical polarization holder unit 30*a* and a horizontal polarization holder unit 30*b*. The holder unit 300 is connected to the OMT 1 through a flange 12*a*. The fixing adapter 40*a* is slidably held by the holder unit 30*a*, and the fixing adapter 40*b* is slidably held by the holder unit 30*b*. Covers 401*a*, 401*b* are attached to those portions of the fixing adapters 40*a*, 40*b* which are not disposed in the holder unit 300, but exposed, to make the LNBs water-resistant to prevent rainwater or the like from entering the LNBs. Water-resistant seals, e.g., O-rings, are disposed around waveguide ports through which radiowaves pass, between the flange 12*a* and the holder unit 300 and between the holder unit 300 and the LNBs 50*a*, 60*a*. Output cables 80*a*, 80*b* extending from the respective LNBs 50*a*, 50*b* are combined with each other by a combiner 70*a*, and output cables 81*a*, 81*b* extending from the respective LNBs 60*a*, 60*b* are combined with each other by a combiner 70*b*.

It is assumed that the vertical polarization LNB 50*a* fails to operate in the converter assembly 100*a*. The LNBs 50*a*, 50*b* are of an identical structure and are installed in the same direction. The screws are loosened and removed from the vertical polarization holder unit 30*a*, and the cover 401*a* is detached from the LNB 50*b*. The fixing adapter 40*a* is slid in the holder unit 30*a* until the LNB 50*b* is positioned in alignment with the vertical branching filter 103 of the OMT 1. After the LNB 50*b* is aligned with the vertical branching filter 103, the fixing adapter 40*a* is fastened again to the holder unit 30*a*. Since the fixing adapter 40*a* is slid to bring the LNB 50*b*, rather than the malfunctioning LNB 50*a*, into alignment with the vertical branching filter 103, any interrupted radio wave reception can be resumed quickly.

Inasmuch as the malfunctioning LNB 50*a* projects from the holder unit 30*a*, the cover 401*a* is mounted on the LNB 50*a* over its radio wave receiving port to protect the interior mechanism of the malfunctioning LNB 50*a*.

In the event that the LNB 60*a* suffers a failure, the normal LNB 60*b* is brought into alignment with the horizontal branching filter 104 for quickly resuming any interrupted radio wave reception.

In the second embodiment, as described above, the LNBs 50*a*, 50*b* which are of an identical structure and oriented in the same direction, and the LNBs 60*a*, 60*b* which are of an identical structure and oriented in the same direction are secured to the fixing adapters 40*a*, 40*b*, and the fixing adapters 40*a*, 40*b* are slidably mounted on the holder unit 300. Even when either the LNB 50*a* or the LNB 60*a* malfunctions, the other normal LNB 50*b* or 60*b* can be used as a spare LNB and simply moved to replace the malfunctioning LNB. Accordingly, as with the first embodiment, the process of replacing the malfunctioning LNB is greatly simplified, and the LNB failure can easily be handled by an ordinary person, rather than a repairman, for quick resumption of any interrupted radio wave reception.

Figure 6:
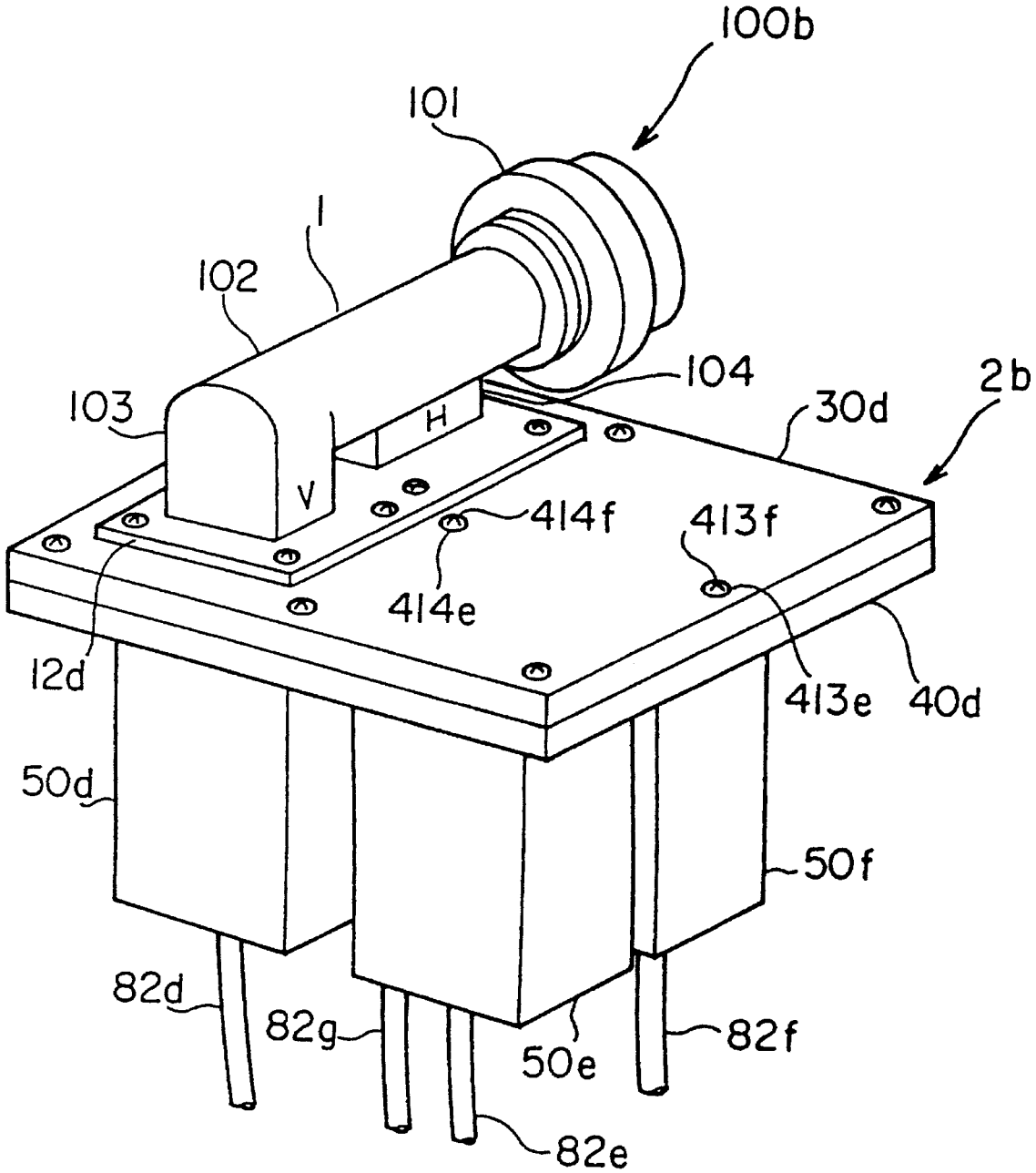
FIG. 6 is a perspective view of a converter assembly of an antenna device according to a third embodiment of the present invention.
Figure 7:
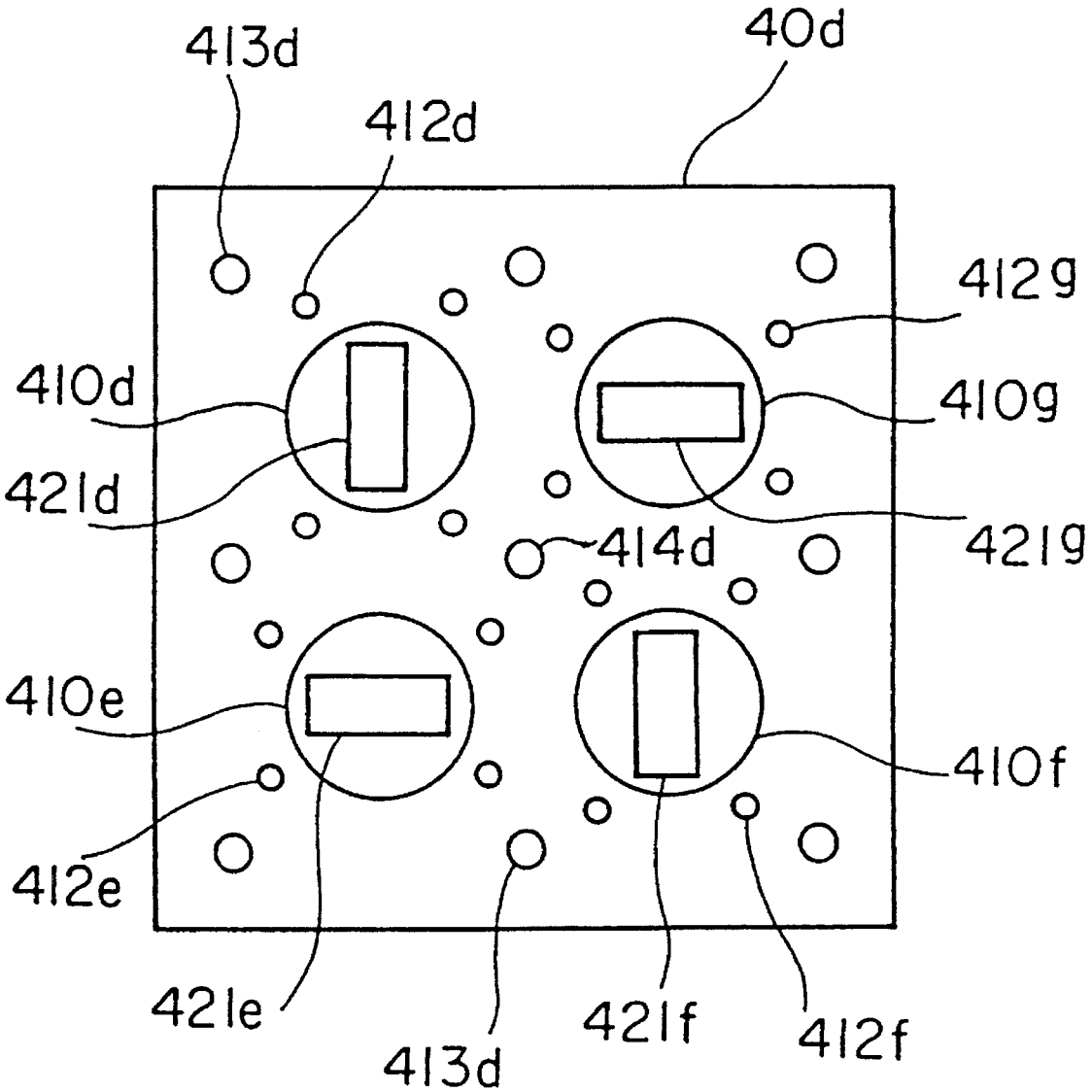
FIG. 7 is a bottom view of a fixing adapter of the converter assembly shown in FIG. 6.

FIGS. 6 and 7 illustrate a converter assembly of an antenna device according to a third embodiment of the present invention. As shown in FIG. 6, the converter assembly, generally denoted at 100*b*, has an OMT 1 which is identical in structure to the OMT 1 shown in FIG. 9, and will not be described in detail below. The converter assembly 100*b* also has an LNB 2*b* which will be described below. In the second embodiment, the LNB 2*b* comprises LNBs 50*d*, 50*e*, 50*f*, 50*g* mounted on a fixing adapter 40*d* at diagonally opposite positions concentrically around the center of the fixing adapter 40*d*. The LNB 50*g* is not shown in FIG. 6 as it is concealed from view.

As shown in FIG. 7, the fixing adapter 40*d* comprises a square plate having O-ring grooves 410*d*, 410*e*, 410*f*, 410*g* defined in a lower surface thereof. The O-ring grooves 410*d*, 410*e*, 410*f*, 410*g* receive O-rings, respectively, which are disposed between the fixing adapter 40*d* and the LNBs 50*d*, 50*e*, 50*f*, 50*g* when the LNBs 50*d*, 50*e*, 50*f*, 50*g* are fixed to the fixing adapter 40*d*. The fixing adapter 40*d* has waveguide ports or radio wave passage openings 421*d*, 421*e*, 421*f*, 421*g* defined therein at the centers, respectively, of the O-ring grooves 410*d*, 410*e*, 410*f*, 410*g*. Any adjacent two of the waveguide ports 421*d*, 421*e*, 421*f*, 421*g* are angularly displaced 90° from each other. The fixing adapter 40*d* has four screw holes 412*d* defined therein around the O-ring groove 410*d*, four screw holes 412*e* defined therein around the O-ring groove 410*e*, four screw holes 412*f* defined therein around the O-ring groove 410*f*, four screw holes 412*g* defined therein around the O-ring groove 410*g*, and eight screw holes 413*d* defined therein along peripheral edges of the fixing adapter 40*d*. These screw holes 412*d*, 412*e*, 412*f*, 412*g*, 413*d* are substantially the same as the screw holes 412, 422, 423 as to their structure, position, and function, and hence will not be described in detail.

The fixing adapter 40*d* also has a screw hole 414*d* defined centrally therein. The O-ring grooves 410*d*~410*g*, the waveguide ports 421*d*~421*g*, the screw holes 412*d*~412*g*, and the screw holes 413*d* are rotationally symmetric with respect to the central screw hole 414*d*. The function of the screw hole 414*d* will be described later on.

As shown in FIG. 6, the holder unit 30*d* is disposed between a flange 12*d* of the OMT 1 and the fixing adapter 40*d*. The holder unit 30*d* has eight screw holes 413*e* defined therein in registry with the respective eight screw holes 413*d* in the fixing adapter 40*d*, and a screw hole 414*e* defined centrally therein in registry with the screw hole 414*d* in the fixing adapter 40*d*. Screws 413*f*, 414*f* are inserted in the screw holes 413*e*, 414*e* thereby to fasten the fixing adapter 40*d* to the holder unit 30*d*.

As with the second embodiment, output cables 82*d*, 82*e* extending from the respective LNBs 50*d*, 50*e* are combined with each other by a combiner (not shown), and output cables 82*f*, 82*g* extending from the respective LNBs 50*f*, 50*g* are combined with each other by a combiner (not shown).

It is assumed that the vertical polarization LNB 50*d* fails to operate in the converter assembly 100*b*. The eight screws 413*f* are loosened and removed, and the central screw 414*f* is loosened. The fixing adapter 40*d* is turned 90° clockwise or counterclockwise about the central screw 414*f*, and then the screws 413*f*, 414*f* are tightened to fasten the fixing adapter 40*d* to the holder unit 30*d*. Since the LNBs 50*d*, 50*e*, 50*f*, 50*g* are rotationally symmetric with respect to the central screw hole 414*f*, the normal LNB 50*e* or 50*g* is positioned in alignment with the vertical branching filter 103.

Therefore, even when one of the LNBs 50*d*~50*g* malfunctions, an adjacent LNB can be used as a spare L in the converter assembly 100*b*NB and simply moved to replace the malfunctioning LNB. Accordingly, as with the first and second embodiments, the process of replacing the malfunctioning LNB is greatly simplified, and the LNB failure can easily be handled by an ordinary person, rather than a repairman, for quickly resuming any interrupted radio wave reception.

In the second embodiment, the malfunctioning LNB is not exposed, and hence no cover is required to be attached to the faulty LNB.

Figure 8:
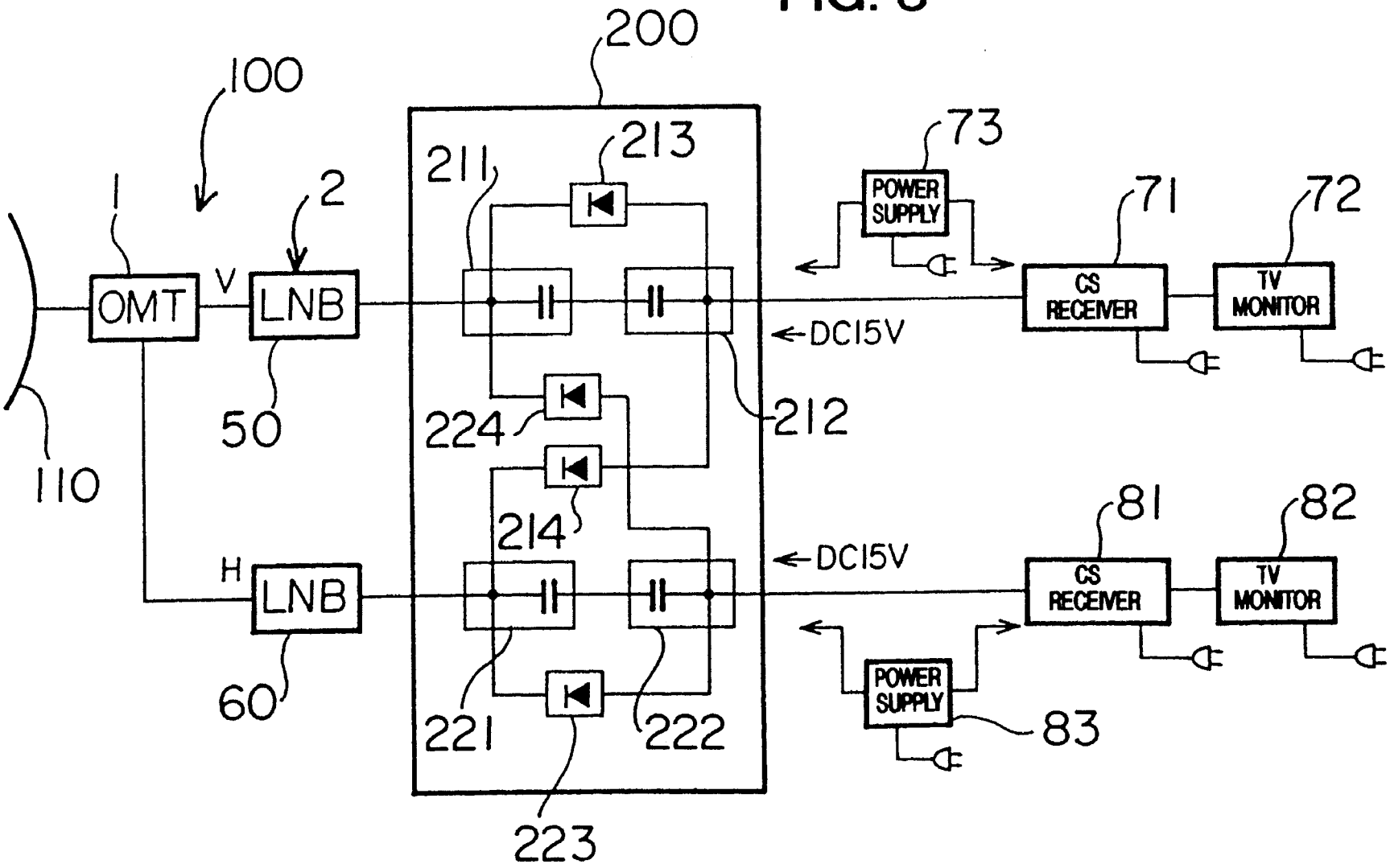
FIG. 8 is a block diagram of a satellite communication reception system according to the present invention.

FIG. 8 shows in block form a satellite communication reception system according to the present invention. The satellite communication reception system has an antenna and a converter assembly which are identical to the antenna 110 and the converter assembly 100, respectively, according to the first embodiment described above. The satellite communication reception system shown in FIG. 8 is a CS broadcast reception system for receiving CS broadcast radiowaves from a satellite with television monitors. The satellite communication reception system has an antenna 110 for efficiently catching a weak 12 GHz radio wave transmitted from a satellite and supplying the received radio wave to the converter assembly 100. The radio wave travels through the OMT 1 to an LNB 2 in which the vertically polarized radio wave V is amplified and converted into a signal having a frequency of 1 GHz by a vertical polarization LNB 50 and the horizontal polarized radio wave H is amplified and converted into a signal having a frequency of 1 GHz by a horizontal polarization LNB 60. The frequency-converted signals are received by respective CS receivers (CS tuners) 71, 81, which output video and audio signals to television monitors 72, 82.

A power supply 73 supplies electric energy having a voltage of DC 15 V to the vertical polarization LNB 50 and the CS receiver 71, and a power supply 83 supplies electric energy having a voltage of DC 15 V to the horizontal polarization LNB 60 and the CS receiver 81. The satellite communication reception system is composed of a vertical polarization system and a horizontal polarization system.

The satellite communication reception system also includes a power supply switching box 200 connected between the LNB 50 and the power supply 73 and also between the LNB 60 and the power supply 83. The power supply switching box 200 comprises two series-connected capacitors 211, 212 connected between the vertical polarization LNB 50 and the CS receiver 71, and two series-connected capacitors 221, 222 connected between the horizontal polarization LNB 60 and the CS receiver 81. The power supply switching box 200 also has a diode 213 connected between the power supply 73 and the LNB 50 parallel to the capacitors 211,212, a diode 223 connected between the power supply 83 and the LNB 60 parallel to the capacitors 221, 222, a diode 214 connected between the power supply 73 and the LNB 60, and a diode 224 connected between the power supply 83 and the LNB 50.

In the power supply switching box 200, the capacitors 211, 212, 221, 222 serve to cut off DC components and pass only AC components. Therefore, the electric energy is supplied from the power supply 73 to the LNB 50 through the diode 213, and the electric energy is supplied from the power supply 83 to the LNB 60 through the diode 223. Signals are transmitted from the LNB 50 to the CS receiver 71 through the capacitors 211, 212 and signals are transmitted from the LNB 60 to the CS receiver through the capacitors 221,222.

If the power supply 73 malfunctions and any voltage is no longer applied from the power supply 73 to the LNB 50, then the diode 224 connected between the power supply 83 and the LNB 50 is rendered conductive, and the voltage from the power supply 83 is applied through the diode 224 to the LNB 50. If the power supply 83 malfunctions and any voltage is no longer applied from the power supply 83 to the LNB 60, then the diode 214 connected between the power supply 73 and the LNB 60 is rendered conductive, and the voltage from the power supply 73 is applied through the diode 214 to the LNB 60.

Therefore, even when one of the LNBs 50, 60 is no longer supplied with the voltage from the power supply of its own system, it can receive the voltage from the power supply of the other system. At this time, signals from the active LNB 50 or 60 are transmitted through its own system to the CS receiver 71 or 81. Accordingly, even in the event of a power supply failure, the satellite communication reception system can operate normally to receive radio wave signals immediately after the faulty condition has occurred, and the CS receiver 71 or 81 can output video and output signals to the television monitor 72 or 82.

While the power supplies 73, 83 are employed to supply electric energy to the LNBs 50, 60 in the illustrated embodiment, electric energy may be supplied from the CS receivers 71, 81 to the LNBs 50, 60.

With the arrangement of the present invention, as described above, since the antenna device has the waveguide unit composed of the straight waveguide and the twisted waveguide, the two LNBs combined therewith may be identical in structure to each other and oriented in the same direction as each other. The two LNBs are secured to the fixing adapter, which is slidably mounted on the holder unit.

Consequently, even in the event of a malfunction of one of the LNBs, the other normal LNB can be used as a spare LNB and simply moved to replace the malfunctioning Accordingly, the process of replacing the malfunctioning LNB is greatly simplified, and the LNB failure can easily be handled by an ordinary person, rather than a repairman, for quick resumption of any interrupted radio wave reception.

The satellite communication reception system has power supplies that are available to both the vertical and horizontal polarization systems thereof. Even in the event that one of the LNBs is not supplied with electric energy from its own system, i.e., the vertical or horizontal polarization system, it can be supplied with electric energy from the other system. At this time, signals from the active LNB are transmitted through its own system to the CS receiver. Accordingly, the satellite communication reception system can operate normally to receive radio wave signals immediately after the faulty condition has occurred, and the CS receiver can output video and output signals to the television monitor.

The foregoing is considered as illustrative only of the principles of the present invention. Further, since numerous modifications and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. An antenna device for receiving radio wave transmitted from a communication satellite, converting the received radio wave into an electric signal, amplifying the signal, and outputting the amplified signal to a receiver, comprising:

a pair of low-noise block converters for converting radio waves supplied from respective radio wave receiving ports thereof into electric signals and amplifying the electric signals;

a fixing adapter, said low-noise block converters being arranged in an array and fixed at the radio wave receiving ports thereof to said fixing adapter, said fixing adapter having a pair of respective radio wave passage openings in registry with said radio wave receiving ports, respectively, of the low-noise block converters;

a holder unit, said fixing adapter being held on said holder unit for a sliding movement in a direction along said array, said holder unit having a pair of respective radio wave passage openings in registry with said radio wave passage openings, respectively, of said fixing adapter, and a waveguide unit mounted on a surface of said holder unit remotely from said fixing adapter and adapted to be connected to an orthogonal mode transducer for receiving a radio wave from the satellite, said waveguide unit comprising a straight waveguide for guiding a radio wave from the orthogonal mode transducer straight to one of said low-noise block converters and a twisted waveguide for turning a radio wave from the orthogonal mode transducer through 90° and guiding the radio wave to one of said low-noise block converters.

2. An antenna device according to claim 1, wherein said holder unit comprises a relatively thick plate having a pair of laterally spaced inturned flanges along respective longitudinal edges thereof, said fixing adapter having longitudinal edges which are slidably fitted in the inturned flanges, respectively.

3. An antenna device according to claim 1, wherein said holder unit and said fixing adapter are fastened to each other by screws, said fixing adapter being slidable with respect to said holder unit with the screws removed.

4. An antenna device according to claim 3, wherein said holder unit and said fixing adapter have screw holes defined therein for insertion of the respective screws therein, said screw holes being positioned such that when said fixing adapter is slid longitudinally with respect to said holder unit, the screw holes in said fixing adapter can be shared by the screw holes in said holder unit.

5. An antenna device according to claim 4, wherein said fixing adapter and said low-noise block converters are fastened to each other by a plurality of screws at positions different from positions in which said holder unit and said fixing adapter are fastened to each other by the plurality of screws.

6. An antenna device according to claim 5, wherein said fixing adapter has a plurality of screw holes defined therein for insertion of the respective screws therein to fasten the fixing adapter to said low-noise block converters, each of the plurality of screw holes has a spot-faced hole defined in a surface of the fixing adapter which is held in contact with said holder unit.

7. An antenna device according to claim 1, further comprising water-resistant seals disposed around said radio wave receiving ports, respectively, of the low-noise block converters between said fixing adapter and said low-noise block converters.

8. An antenna device according to claim 1, further comprising water-resistant seals disposed around said radio wave receiving ports, respectively, of the fixing adapter between said holder unit and said fixing adapter.

9. An antenna device for receiving a radio wave transmitted from a communication satellite, converting the received radio wave into an electric signal, amplifying the signal, and outputting the amplified signal to a receiver, comprising:

a pair of vertical polarization low-noise block converters for converting vertically polarized radio waves supplied from respective radio wave receiving ports thereof into electric signals and amplifying the electric signals;

a pair of horizontal polarization low-noise block converters for converting horizontally polarized radio waves supplied from respective radio wave receiving ports thereof into electric signals and amplifying the electric signals;

a vertical polarization fixing adapter, said vertical polarization low-noise block converters being arranged in an array and fixed at the radio wave receiving ports thereof to said vertical polarization fixing adapter, said vertical polarization fixing adapter having a pair of respective radio wave passage openings in registry with said radio wave receiving ports, respectively, of the vertical polarization low-noise block converters;

a horizontal polarization fixing adapter, said horizontal polarization low-noise block converters being arranged in an array and fixed at the radio wave receiving ports thereof to said horizontal polarization fixing adapter, said horizontal polarization fixing adapter having a pair of respective radio wave passage openings in registry with said radio wave receiving ports, respectively, of the horizontal polarization low-noise block converters;

a holder unit having a vertical polarization holder and a horizontal polarization holder, said vertical polarization fixing adapter being held on said vertical polarization holder for a sliding movement in a direction along said array, said vertical polarization holder having a radio wave passage opening in registry with one of said radio wave passage openings, respectively, of said vertical polarization fixing adapter, said horizontal polarization fixing adapter being held on said horizontal polarization holder for a sliding movement in a direction along said array, said horizontal polarization holder having a radio wave passage opening in registry with one of said radio wave passage openings, respectively, of said horizontal polarization fixing adapter; and an orthogonal mode transducer mounted on a surface of said holder unit remotely from said vertical and horizontal fixing adapters, for guiding vertically and horizontally polarized radio waves branched from the radio wave from the communication satellite into the radio wave passage openings of said holder unit.

10. An antenna device for receiving a radio wave transmitted from a communication satellite, converting the received radio wave into an electric signal, amplifying the signal, and outputting the amplified signal to a receiver, comprising:

a pair of vertical polarization low-noise block converters for converting vertically polarized radio waves supplied from respective radio wave receiving ports thereof into electric signals and amplifying the electric signals;

a pair of horizontal polarization low-noise block converters for converting horizontally polarized radio waves supplied from respective radio wave receiving ports thereof into electric signals and amplifying the electric signals;

a fixing adapter, said vertical and horizontal polarization low-noise block converters being arranged at diagonally opposite positions concentrically around the center of said fixing adapter ad fixed at the radio wave receiving ports thereof to said fixing adapter, said fixing adapter having a plurality of respective radio wave passage openings in registry with said radio wave receiving ports, respectively, of the vertical and horizontal polarization low-noise block converters, said fixing adapter having a hole defined therein at the center thereof for rotation about the hole;

a holder unit, said fixing adapter being held on said holder unit, said holder unit having a pair of respectively radio wave passage openings in registry with respective ones of said radio wave passage openings, respectively, of said fixing adapter, said holder unit having a hole defined therein for rotation about the hole, said hole of the holder unit being held in registry with said hole of the fixing adapter; and an orthogonal mode transducer mounted on a surface of said holder unit remotely from said fixing adapter, for guiding vertically and horizontally polarized radio waves branched from the radio wave from the communication satellite into the radio wave passage openings of said holder unit.

11. An antenna device for receiving radio wave transmitted from a communication satellite, converting the received radio wave into an electric signal, amplifying the signal, and outputting the amplified signal to a receiver, comprising:

a pair of low-noise block converters for converting radio waves supplied from respective radio wave receiving ports thereof into electric signals and amplifying the electric signals;

a fixing adapter, said low-noise block converters being arranged in an array and fixed at the radio wave receiving ports thereof to said fixing adapter, said fixing adapter having a pair of respective radio wave passage openings in registry with said radio wave receiving ports, respectively, of the low-noise block converters;

a holder unit, said fixing adapter being held on said holder unit for a sliding movement in a direction along said array, said holder unit having a pair of respective radio wave passage openings in registry with said radio wave passage openings, respectively, of said fixing adapter, and a waveguide unit mounted on a surface of said holder unit remotely from said fixing adapter and adapted to be connected to an orthogonal mode transducer for receiving a radio wave from the satellite, said waveguide unit comprising a straight waveguide for guiding a radio wave from the orthogonal mode transducer straight to one of said low-noise block converters and a twisted waveguide for turning a radio wave from the orthogonal mode transducer through 90° and guiding the radio wave to one of said low-noise block converters;

wherein said fixing adapter and said low-noise block converters are fastened to each other by a plurality of screws at positions different from positions in which said holder unit and said fixing adapter are fastened to each other by the plurality of screws.

12. An antenna device for receiving radio wave transmitted from a communication satellite, converting the received radio wave into an electric signal, amplifying the signal, and outputting the amplified signal to a receiver, comprising:

a pair of low-noise block converters for converting radio waves supplied from respective radio wave receiving ports thereof into electric signals and amplifying the electric signals;

a fixing adapter, said low-noise block converters being arranged in an array and fixed at the radio wave receiving ports thereof to said fixing adapter, said fixing adapter having a pair of respective radio wave passage openings in registry with said radio wave receiving ports, respectively, of the low-noise block converters;

a holder unit, said fixing adapter being held on said holder unit for a sliding movement in a direction along said array, said holder unit having a pair of respective radio wave passage openings in registry with said radio wave passage openings, respectively, of said fixing adapter, and a waveguide unit mounted on a surface of said holder unit remotely from said fixing adapter and adapted to be connected to an orthogonal transducer for receiving a radio wave from the satellite, said waveguide unit comprising a straight waveguide for guiding a radio wave from the orthogonal mode transducer straight to one of said low-noise block converters and a twisted waveguide for turning a radio wave from the orthogonal mode transducer through 90° and guiding the radio wave to one of said low-noise block converters;

wherein said fixing adapter has a plurality of screw holes defined therein for insertion of the respective screws therein to fasten the fixing adapter to said low-noise block converters, each of the plurality of screw holes has a spot-faced hole defined in a surface of the fixing adapter which is held in contact with said holder unit.

* * * * *

UNITED STATES PATENT AND TRADEMARK OFFICE

CERTIFICATE OF CORRECTION

PATENT NO. : 5,600,336

DATED : February 4, 1997

INVENTOR(S) : Kubo et al.

It is certified that error appears in the above-identified patent and that said Letters Patent is hereby corrected as shown below:

On the cover page, item [75]

Inventors, "Kazuhara Kubo" should be --Kazuharu Kubo--.

Signed and Sealed this

Fifteenth Day of September, 1998

Bruce Lehman

*Attest:*

BRUCE LEHMAN

*Attesting Officer*

*Commissioner of Patents and Trademarks*